US006363659B1

(12) United States Patent
Wang

(10) Patent No.: US 6,363,659 B1
(45) **Date of Patent: *Apr. 2, 2002**

(54) STORM RESISTANT WINDOW BRACKET

(75) Inventor: Hui Wang, Flushing, NY (US)

(73) Assignee: Crystal Window & Door Systems, Ltd., Flushing, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/448,331

(22) Filed: Nov. 23, 1999

(51) Int. Cl.[7] ..... E05D 15/22
(52) U.S. Cl. ..... 49/183; 49/394
(58) Field of Search ..... 49/176, 182, 183, 49/181, 187, 449, 394; 16/DIG. 6; 292/DIG. 20, DIG. 47

(56) References Cited

U.S. PATENT DOCUMENTS 1,859,491 A * 5/1932 Baer ..... 49/182
4,114,317 A 9/1978 Crawley
4,338,996 A 7/1982 Frank
4,480,406 A 11/1984 Frank
4,486,978 A 12/1984 Frank
4,525,952 A * 7/1985 Cunningham et al. ..... 49/449
4,776,133 A * 10/1988 Green ..... 49/394
4,864,773 A * 9/1989 Pucci ..... 49/394
5,103,589 A 4/1992 Crawford
5,560,149 A 10/1996 Lafevre

* cited by examiner

*Primary Examiner*—Jerry Redman
(74) *Attorney, Agent, or Firm*—Collard & Roe, P.C.

(57) ABSTRACT

A storm resistant device for a window that has a window frame enclosing at least one sash slidingly and pivotally mounted therein. The sash has side rails and the frame has vertical jambs that engage the side rails of the sash to raise and lower and pivot the sash. The storm resistant device comprises a first elongated bracket having a substantially Z-shaped cross section with two end segments and a middle segment connecting the two end segments. The middle segment is connectable to the side rails of the sashes with one of the end segments extending outward from the sash toward an adjacent jamb. There is a second elongated bracket having a substantially L-shaped cross section with two legs, one leg of the bracket adapted to be mounted to the jamb with a second leg of the L extending toward an adjacent side rail of the sash. The first and second brackets are mounted to the frame and sash, respectively, so that when the sash is closed, the one end segment of the first bracket interlocks with the second leg of the second bracket and prevents the sash from pivoting when pressure is applied to the sash.

12 Claims, 3 Drawing Sheets

STORM RESISTANT WINDOW BRACKET

BACKGROUND OF THE INVENTION

1. Field of the Invention

This invention relates to a bracket for use on a sash-type window. In particular, the invention relates to a bracket that is mounted on a pivoting sash window that prevents the window from pivoting during storms and high winds.

2. The Prior Art

One of the improvements in window technology in recent years is the development of sash type or "double hung" windows in which each half of the window pivots inward to facilitate cleaning. This way, the outer surfaces of the window panes can be cleaned from inside the building. While this has been a great convenience for many, it has also posed a hazard for some, especially those people inhabiting storm-prone areas. This is because in high winds, the sashes of the windows tend to become disengaged from the frame and pivot inward, thus opening the window and increasing the risk of damage to the window and to the home.

One solution to this problem is to specifically construct a storm-proof window for these areas. Such a solution is posed by U.S. Pat. No. 5,560,149 to LeFevre. However, this does not assist those people who have conventional windows already mounted in their homes, and who do not want to or cannot replace the windows entirely.

SUMMARY OF THE INVENTION

It is therefore an object of the present invention to provide an after-market device that prevents sash-type windows from blowing inward during a storm.

It is another object of the invention to provide such a device that permits normal sliding and pivoting of the window.

It is a further object of the invention to provide a such a device that is simple and inexpensive to manufacture, as well as easy to install.

These an other objects of the invention are accomplished by a storm resistant device for a window that has a window frame enclosing at least one sash slidingly and pivotally mounted therein. The sash has side rails and the frame has vertical jambs that engage the side rails of the sash to raise and lower and pivot the sash. The storm resistant device comprises a first elongated bracket having a substantially Z-shaped cross section with two end segments and a middle segment connecting the two end segments. The middle segment is connectable to the side rails of the sashes, with one of the end segments extending outward from the sash toward an adjacent jamb. There is a second elongated bracket having a substantially L-shaped cross section with two legs, one leg of the bracket adapted to be mounted to the jamb, with a second leg of the L extending toward an adjacent side rail of the sash. The first and second brackets are mounted to the frame and sash, respectively, so that when the sash is closed, the one end segment of the first bracket interlocks with the second leg of the second bracket and prevents the sash from pivoting when pressure is applied to the sash.

The brackets are preferably mounted to the window components via screws threaded through holes in the brackets. Each bracket is preferably about three inches in length, but other dimensions are also effective. The preferred material for the brackets is steel, but other materials such as aluminum, brass or any other strong material are suitable as well.

To form an effective interlocking arrangement, the second leg of the second bracket is approximately one inch long, which creates a strong lock against any counterforces caused by wind gusts against the window.

The first bracket preferably has a ridge extending along its length, and positioned at approximately a central point of the middle section. The ridge is adapted to securely position the first bracket within the jamb without play.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
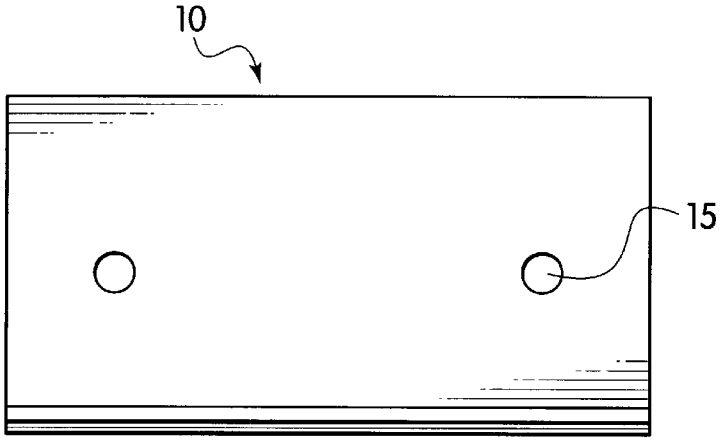
FIG. 1 shows a top view of a first bracket of the device according to the invention.
Figure 2:
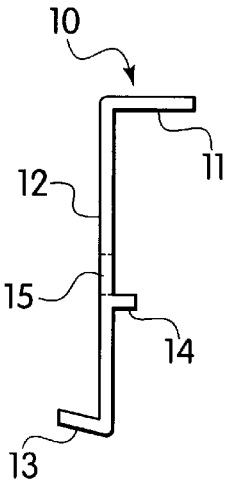
FIG. 2 shows a side view of the bracket shown in FIG. 1.

Referring now in detail to the drawings and, in particular, FIGS. 1 and 2, there is shown a first bracket 10 of the device according to the invention. Bracket 10 is substantially Z-shaped, having a first leg 11, a middle leg 12 and a third leg 13. There is a ridge 14 extending the length of bracket 10 and running parallel to first leg 11, to create a more secure mounting when bracket 10 is mounted to a window sash. Bracket 10 is preferably about 3 inches in length, but shorter or longer brackets will also work.

Figure 3:
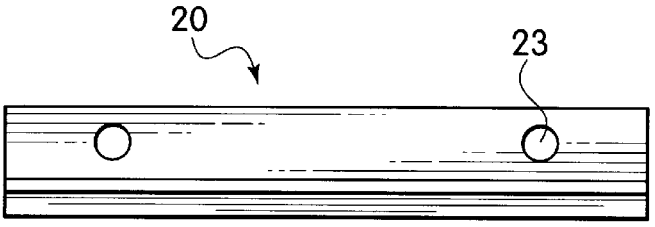
FIG. 3 shows a top view of a second bracket used with the device according to the invention.
Figure 4:
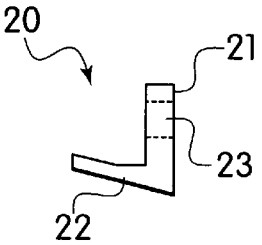
FIG. 4 shows a side view of the bracket of FIG. 3.

The other component of the device according to the invention is shown in FIGS. 3 and 4, which shows the second bracket 20. Bracket 20 is substantially L-shaped and has a first leg 21 connected to a second leg 22. Second bracket 20 is also about 3 inches in length, but other dimensions could also be used. It is preferable if both the first and second brackets are the same length, because the device only works to the extent the two brackets interlock with one another.

Figure 5:
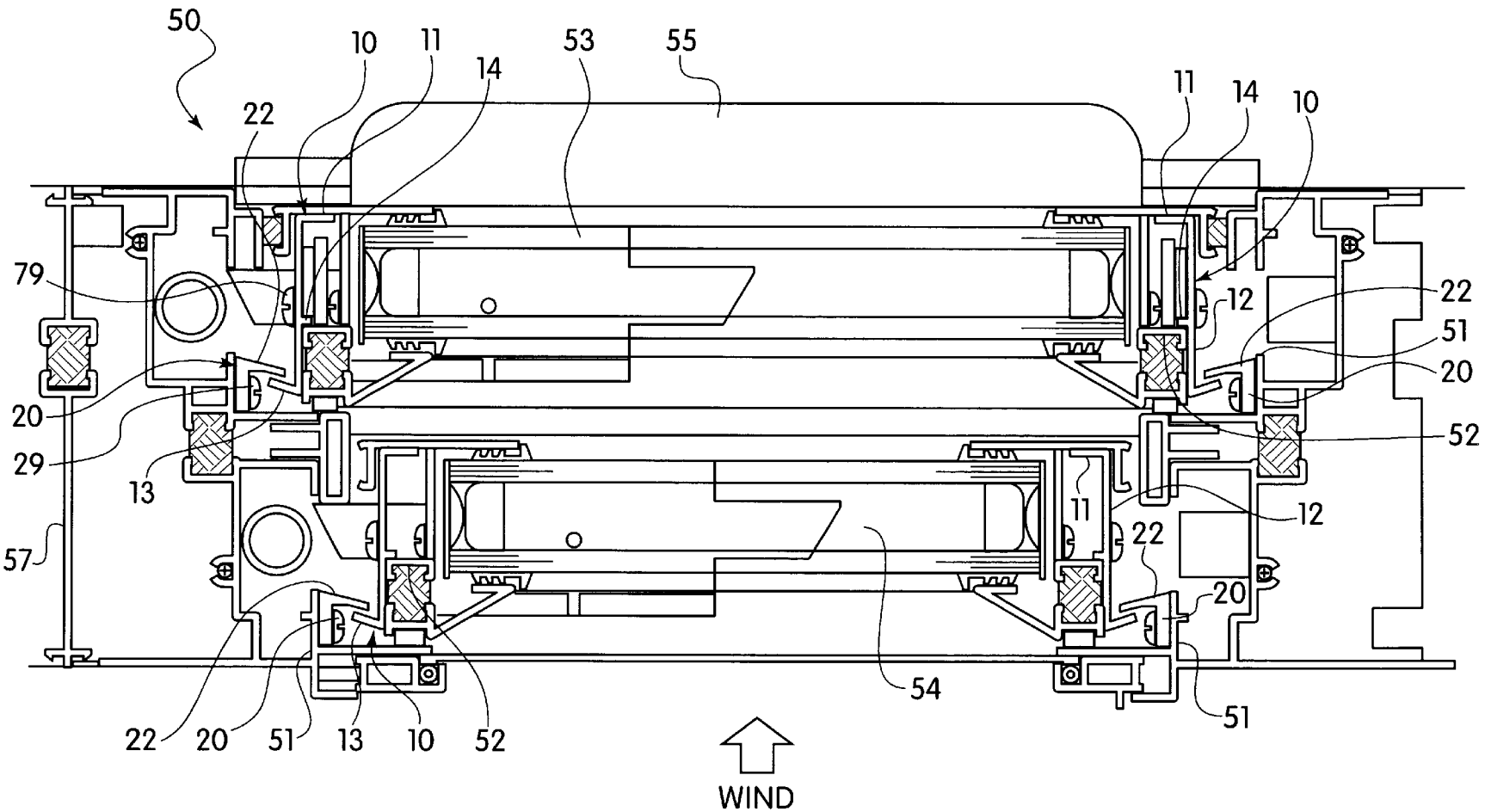
FIG. 5 shows a top cross-sectional view of a double-hung window having the device according to the invention installed thereon.

Bracket 20 is mounted to a window frame via screws 29 threaded through holes 23, and bracket 10 is mounted to a window sash via screws 19 threaded through holes 15 (shown in FIG. 5).

Figure 6:
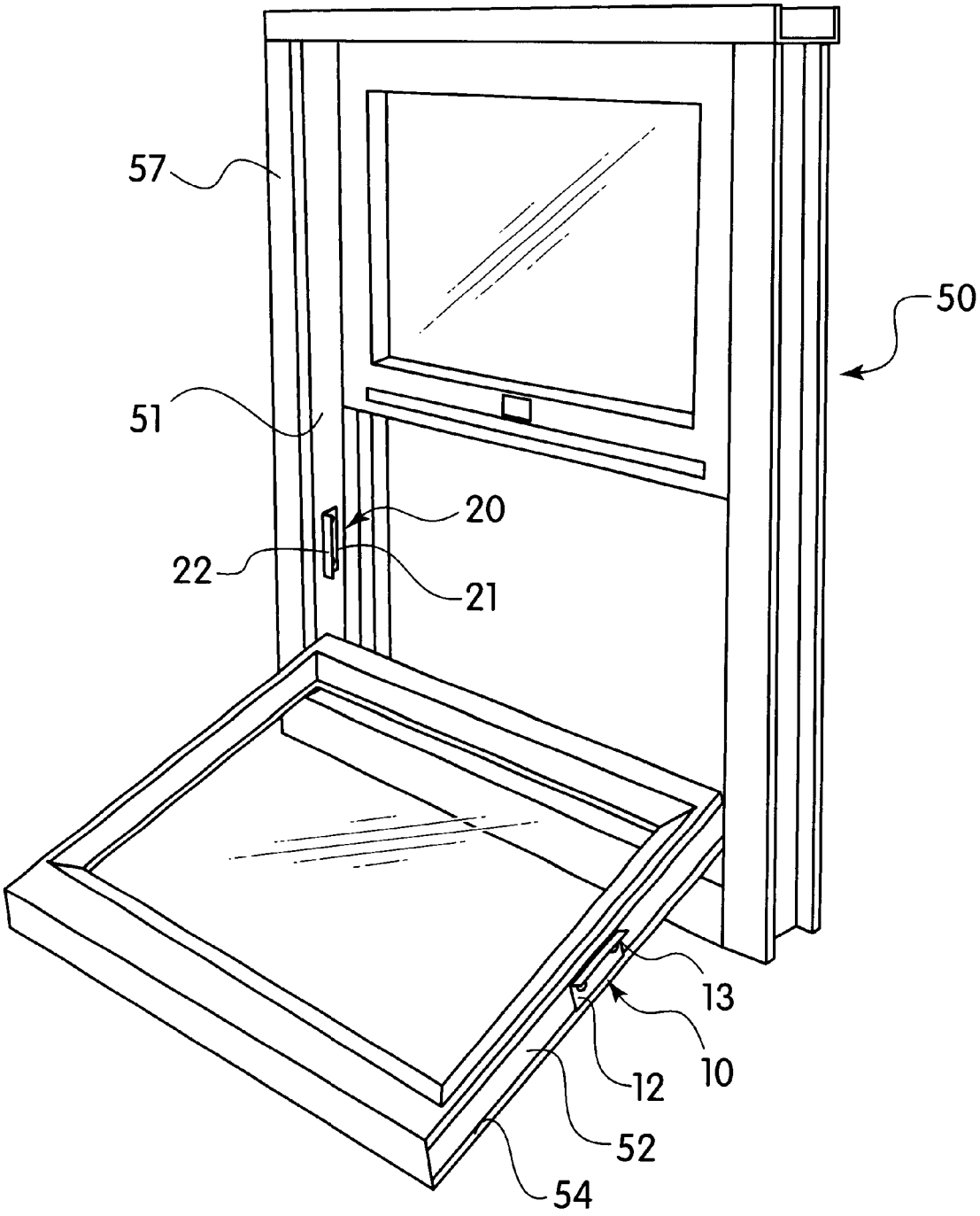
FIG. 6 shows a side perspective view of a window having the device according to the invention mounted thereon, in an open, pivoted position.

FIGS. 5 and 6 show brackets 10 and 20 as they are mounted to a double-hung sash window 50 having a sill 55, to prevent the sashes from pivoting inward during strong winds. Bracket 10 is mounted to the vertical side rails 52 of upper and lower sashes 53 and 54 so that leg 13 extends outward toward window frame 57. Bracket 20 is mounted to the vertical jamb 51 of window frame 57 so that leg 22 of bracket 20 extends inward toward sashes 53 and 54. This way, when the sashes are closed, leg 13 of bracket 10 and leg 22 of bracket 20 interlock and prevent any pivoting movement of the sashes when they are hit by wind gusts from the direction of the arrows shown in FIG. 5.

FIG. 6 shows a perspective view of window 50 with brackets 10 and 20 mounted thereon. Sashes 53 and 54 can still be pivoted for cleaning by raising the sash to a point where brackets 10 and 20 do not connect and then pivoting the sash outward. Brackets 10 and 20 are very inexpensive to produce and are easily installed via screws, and can prevent costly damage during a storm.

Accordingly, while only one embodiment of the present invention has been shown and described, it is obvious that many changes and modifications may be made thereunto without departing from the spirit and scope of the invention.

What is claimed is:

1. A storm resistant device for attaching to a window, the window having a window frame enclosing at least one sash, said device comprising:

a first elongated bracket having a substantially Z-shaped cross section with two end segments and a middle segment connecting said two end segments, and a second elongated bracket having a substantially L-shaped cross section with a first leg and a second leg, wherein the first bracket is adapted to be mounted to a side rail of the sash via the middle section and the second bracket is adapted to be mounted to a jamb of the window frame with the first leg and the second leg of the L extending toward an adjacent side rail of the sash, said one end segment of said first bracket engaging the second leg of the second bracket and preventing the sash from pivoting when lateral pressure is applied to the sash when the sash is closed.

2. The device according to claim 1, wherein each bracket has at least one hole therethrough, and further comprising a plurality of screws for attaching each bracket to the frame and sash through each hole.

3. The device according to claim 1, wherein each bracket is about three inches in length.

4. The device according to claim 1, wherein each bracket is made of aluminum.

5. The device according to claim 1, wherein said second leg of said second bracket is approximately one inch long.

6. The device according to claim 1, wherein the first bracket has a ridge extending along its length, said ridge being positioned at approximately a central point of the middle section and adapted to securely position said first bracket within the jamb without play.

7. A storm resistant device in combination with a window having a window frame enclosing at least one sash slidingly and pivotally mounted therein, said sash having side rails and said frame having vertical jambs that engage the side rails of the sash to raise and lower and pivot the sash, said device comprising:

a first elongated bracket having a substantially Z-shaped cross section with two end segments and a middle segment connecting said two end segments, said middle segment connected to the side rails of the sashes with one of the end segments extending outward from the sash toward an adjacent jamb, and a second elongated bracket having a substantially L-shaped cross section with two legs, one leg of the second bracket mounted to the jamb with a second leg of the L extending toward an adjacent side rail of the sash, wherein when the sash is closed, said one end segment of said first bracket engages the second leg of the second bracket and prevents the sash from pivoting when lateral pressure is applied to the sash.

8. The combination according to claim 7, wherein each bracket has at least one hole therethrough, and is attached to the frame and sash via a plurality of screws inserted through each hole.

9. The combination according to claim 7, wherein each bracket is about three inches in length.

10. The combination according to claim 7, wherein each bracket is made of aluminum.

11. The combination according to claim 7, wherein said second leg of said second bracket is approximately one inch long.

12. The combination according to claim 7, wherein the first bracket has a ridge extending along its length, said ridge being positioned at approximately a central point of the middle section and securely positioning said first bracket within the jamb without play.

* * * * *